US009776066B2

(12) United States Patent
Naito et al.

(10) Patent No.: US 9,776,066 B2
(45) Date of Patent: Oct. 3, 2017

(54) SNOWBOARD BINDING

(71) Applicant: CAR MATE MFG. CO., LTD., Tokyo (JP)

(72) Inventors: Hideyuki Naito, Tokyo (JP); Taku Kanai, Tokyo (JP)

(73) Assignee: CAR MATE MFG. CO., LTD., Tokyo (JP)

( * ) Notice: Subject to any disclaimer, the term of this patent is extended or adjusted under 35 U.S.C. 154(b) by 0 days.

(21) Appl. No.: 15/108,100

(22) PCT Filed: Nov. 13, 2014

(86) PCT No.: PCT/JP2014/005719
§ 371 (c)(1),
(2) Date: Jun. 24, 2016

(87) PCT Pub. No.: WO2015/102036
PCT Pub. Date: Jul. 9, 2015

(65) Prior Publication Data

US 2016/0325174 A1 Nov. 10, 2016

(30) Foreign Application Priority Data

Jan. 6, 2014 (JP) ..... 2014-000585

(51) Int. Cl.
*A63C 10/06* (2012.01)
*A63C 10/14* (2012.01)

(52) U.S. Cl.
CPC ..... *A63C 10/145* (2013.01); *A63C 10/06* (2013.01)

(58) Field of Classification Search
CPC ..... A63C 10/16; A63C 10/04; A63C 11/00; A63C 10/285; A63C 10/24; A63C 10/145; A63C 10/06
See application file for complete search history.

(56) References Cited

U.S. PATENT DOCUMENTS 5,745,959 A * 5/1998 Dodge ..... A43C 11/00 24/68 SK
5,971,407 A * 10/1999 Zemke ..... A63C 10/285 280/14.22
6,009,638 A * 1/2000 Maravetz ..... A43B 5/0401 36/115
(Continued)

FOREIGN PATENT DOCUMENTS

DE 202009004001 U1 6/2009
FR 2889967 A1 3/2007
(Continued)

OTHER PUBLICATIONS

Jan. 27, 2015 Search Report issued in International Patent Application No. PCT/JP2014/005719.

*Primary Examiner* — Hau Phan
(74) *Attorney, Agent, or Firm* — Oliff PLC

(57) ABSTRACT

A toe strap of a snowboard binding is constituted of one belt to fasten an upper portion of a tiptoe of a boot and another belt to fasten a tip of the tiptoe of the boot, and it is a problem to have a configuration to guide the toe strap so as to be fastened to an appropriate position with respect to a shape of the tiptoe portion of the boot when the boot is mounted. At least any one belt of the one belt and the other belt of the toe strap includes an extending portion that extends at least any direction of front and rear on a center position in a lateral direction, and the extending portion of the belt is configured to abut on the boot prior to a non-extending portion of the belt on an adjacent position when the boot is mounted.

7 Claims, 5 Drawing Sheets

(56) References Cited

U.S. PATENT DOCUMENTS 6,206,403 B1 * 3/2001 Black ..... A63C 10/06 280/14.22
6,581,944 B1 * 6/2003 Marmonier ..... A63C 10/24 280/14.22
6,679,516 B2 * 1/2004 Andrevon ..... A63C 10/06 280/14.22
6,773,020 B2 * 8/2004 Gonthier ..... A63C 10/06 280/14.21
6,938,904 B2 * 9/2005 Dalgaard ..... A63C 10/04 280/14.21
7,278,651 B2 * 10/2007 Naito ..... A63C 10/04 280/11.36
7,374,194 B2 * 5/2008 Naito ..... A63C 10/04 280/611
7,669,880 B2 * 3/2010 Doyle ..... A43C 11/146 280/11.36
7,766,364 B2 * 8/2010 Cunningham ..... A43C 11/146 280/11.36
8,146,940 B2 * 4/2012 Hahnenberger ..... A63C 10/06 280/14.21
8,763,209 B2 * 7/2014 Kavarsky ..... A43C 11/1413 24/68 SK
9,114,309 B1 * 8/2015 Chang ..... A63C 10/24
9,390,492 B2 * 7/2016 Rotem ..... G06T 7/001
2002/0041081 A1 * 4/2002 Gonthier ..... A43B 5/0403 280/623
2004/0135348 A1 7/2004 Naito et al.
2004/0145128 A1 * 7/2004 Couderc ..... A63C 10/285 280/11.3
2005/0104330 A1 * 5/2005 Sauter ..... A63C 10/04 280/619

FOREIGN PATENT DOCUMENTS

JP 2004-154593 A 6/2004
JP 2005-318913 A 11/2005
WO 2004/062751 A1 7/2004
WO 2009/021294 A1 2/2009

* cited by examiner

SNOWBOARD BINDING

TECHNICAL FIELD

The present invention relates to a snowboard binding.

BACKGROUND ART

Japanese Unexamined Patent Application Publication No. 2004-154593 discloses a snowboard binding that is constituted of a base plate 2, one band that has one end mounted on one side of the base plate 2, another band that has one end mounted on another side of the base plate 2, and a buckle that couples between other ends of both bands. Any one of the one and other bands includes a portion 71 to fasten a tip of a tiptoe of a boot 100 and a portion 72 to fasten an upper portion of the tiptoe of the boot 100.

However, in this conventional technique, when the band is fastened to the boot 100, the portion 71 to fasten the tip of the tiptoe of the boot 100 and the portion 72 to fasten the upper portion of the tiptoe of the boot 100 are secured to a position different from an appropriate position with respect to the tiptoe of the boot 100. Then, the portion 71 to fasten the tip of the tiptoe of the boot 100 and the portion 72 to fasten the upper portion of the tiptoe of the boot 100 sometimes move from the tiptoe portion of the boot 100 to occur loosening while in use.

Japanese Unexamined Patent Application Publication No. 2005-318913 discloses a snowboard binding that includes a toe strap 5 constituted of a base plate 2, one band that has one end mounted on one side of the base plate 2, another band that has one end mounted on another side of the base plate 2, and a buckle that couples between other ends of both bands. In the toe strap 5, any one of the one and the other bands includes a lower belt 81 secured to a peripheral area of a lower side of a pad 83 to fasten a tip of a tiptoe of a boot 100 and an upper belt 82 secured to a peripheral area of an upper side of the pad 83 to fasten an upper portion of the tiptoe of the boot 100. The pad 83 has stretchability. The toe strap 5 further includes a limiting means (a center regulating member 57) to regulate the stretchability of the pad 83.

The limiting means is constituted of the center regulating member 57 disposed on an outer surface of the pad 83 in a lateral direction. The center regulating member 57 is secured between the lower belt 81, which is secured to the peripheral area of the lower side of the pad 83 to fasten the tip of the tiptoe of the boot 100, and the upper belt 82, which is secured to the peripheral area of the upper side of the pad 83 to fasten the upper portion of the tiptoe of the boot 100. However, when the boot 100 is secured, the lower belt 81, which is secured to the peripheral area of the lower side of the pad 83 to fasten the tip of the tiptoe of the boot 100, and the upper belt 82, which is secured to the peripheral area of the upper side of the pad 83 to fasten the upper portion of the tiptoe of the boot 100, are secured to a position different from an appropriate position with respect to the tiptoe of the boot 100. Then, the pad 83 moves from the tiptoe portion of the boot 100 to occur loosening while in use. The limiting means does not have efficiency for preventing the loosening.

PRIOR ART DOCUMENTS

Patent Documents

Patent Document 1: Japanese Unexamined Patent Application Publication No. 2004-154593

Patent Document 2: Japanese Unexamined Patent Application Publication No. 2005-318913

SUMMARY OF THE INVENTION

Problems to be Solved by the Invention

The problem of the present invention is to provide a snowboard binding that includes a base plate, a toe strap that has one end coupled to one side of the base plate, and a fastening tool. The toe strap is constituted of one belt to fasten an upper portion of a tiptoe of a boot and another belt to fasten a tip of the tiptoe of the boot. The snowboard binding has a configuration where, when the toe strap is fastened to the boot by the fastening tool, the toe strap is easily fastened to an appropriate position with respect to a shape of the tiptoe portion of the boot, and fastening the toe strap to the boot deforms the toe strap to cause a holding force to the boot to be less likely to decrease with respect to loosening of a fastened state.

Solutions to Problem

According to one aspect of the present invention, a snowboard binding includes a base plate that includes a securing means to a snowboard, a back support coupled to a rear end of the base plate, an ankle strap that has one end coupled to one side of the base plate to fasten an instep of a boot, an ankle strap ratchet band that has one end coupled to another side of the base plate, an ankle strap fastening tool disposed on another end of the ankle strap and engaged with the ankle strap ratchet band, a toe strap that has one end coupled to the one side of the base plate to fasten a tiptoe portion of the boot, a toe strap ratchet band that has one end coupled to the other side of the base plate, and a toe strap fastening tool disposed on another end of the toe strap and engaged with the toe strap ratchet band. The toe strap includes one belt configured to fasten an upper portion of the tiptoe of the boot and another belt configured to fasten a tip of the tiptoe of the boot. The snowboard binding is configured such that a fastening operation of the toe strap fastening tool engaged with the toe strap ratchet band moves the toe strap toward the other side of the base plate to cause the one belt and the other belt to simultaneously fasten the upper portion of the tiptoe and the tip of the tiptoe of the boot. In the snowboard binding, at least any one belt of the one belt and the other belt includes an extending portion that extends at least any direction of front and rear on a center position in a lateral direction, and the extending portion of the belt is configured to abut on the boot prior to a non-extending portion of the belt on an adjacent position when the boot is mounted.

According to another aspect of the present invention, the extending portion of the belt is formed thin compared with the belt of the non-extending portion on the adjacent position.

According to another aspect of the present invention, the extending portion of the belt has an abutting surface on the boot formed inclining more to an abutting direction of the boot compared with an abutting surface on the boot of the belt of the non-extending portion on the adjacent position.

According to another aspect of the present invention, the extending portion of the belt includes an outside extending portion that extends from an outside position of the one belt and the other belt in a front-rear direction.

According to another aspect of the present invention, the extending portion of the belt includes an inside extending portion that extends from an inside position of the one belt and the other belt in the front-rear direction.

According to another aspect of the present invention, a center regulating member that regulates an intrusion distance of the tiptoe of the boot to between the one belt and the other belt of the toe strap is disposed on an upper position between the one belt and the other belt of the toe strap in a lateral direction.

Advantageous Effects of Invention

According to the snowboard binding of the present invention, when the fastening tools are used to fasten the toe strap to the boot, an operation of the pair of the right and left front-to-rear width reducing units, and the inside extending portion, and the outside extending portion automatically guides the toe strap to an appropriate securing position with respect to the shape of the tiptoe portion of the boot. This ensures the one belt and the other belt to be smoothly mounted on an appropriate mounting position for the boot. Further, when the toe strap is fastened to the boot, the inside extending portion and the outside extending portion of the toe strap deform, and when a fastened state is loosened, a deformed state of the inside extending portion and the outside extending portion recovers. This prevents a rapid decrease of a holding force to the boot.

DESCRIPTION OF EMBODIMENTS

First Embodiment

Figure 1:
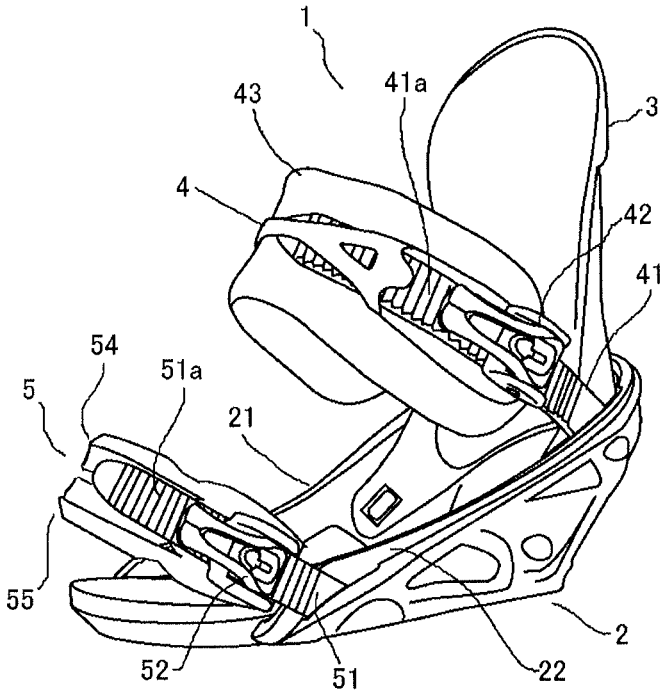
FIG. 1 is a perspective view according to a first embodiment of the present invention.
Figure 2:
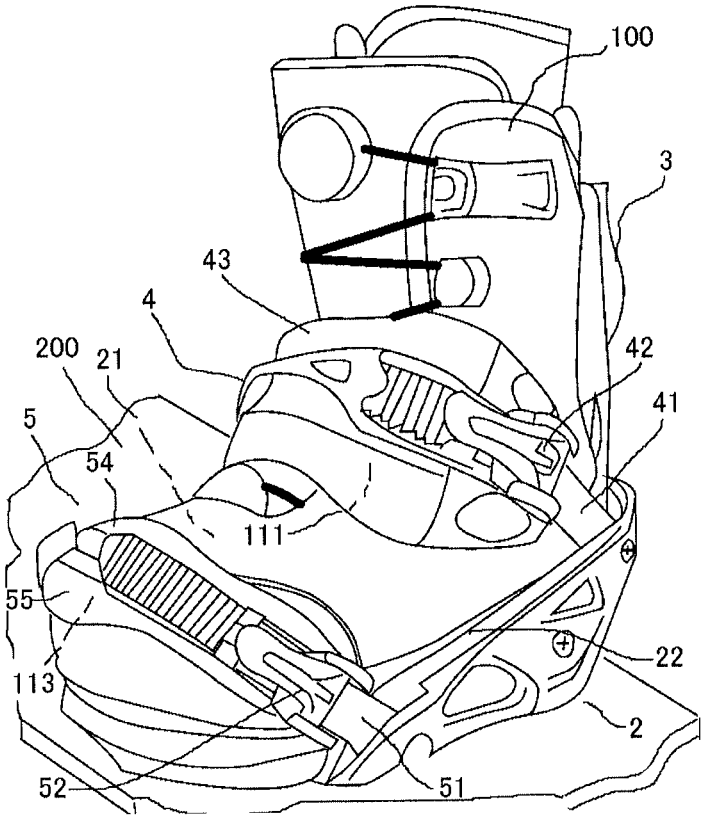
FIG. 2 is a perspective view illustrating a state where a boot is mounted according to the first embodiment of the present invention.
Figure 3:
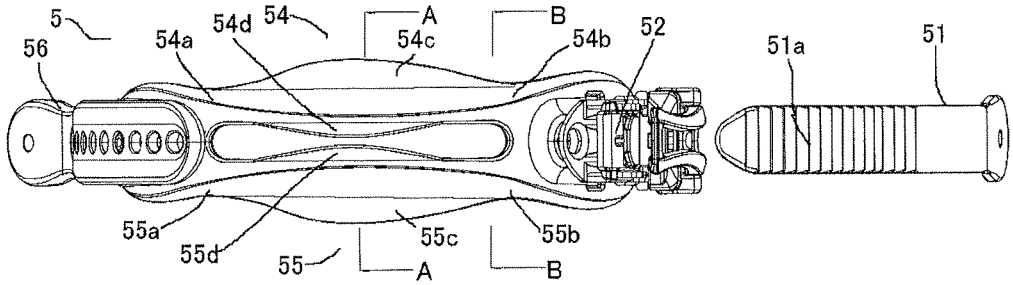
FIG. 3 is a plan view illustrating a toe strap part in a state where a toe strap ratchet band is separated from a toe strap fastening tool according to the first embodiment of the present invention.
Figure 4:
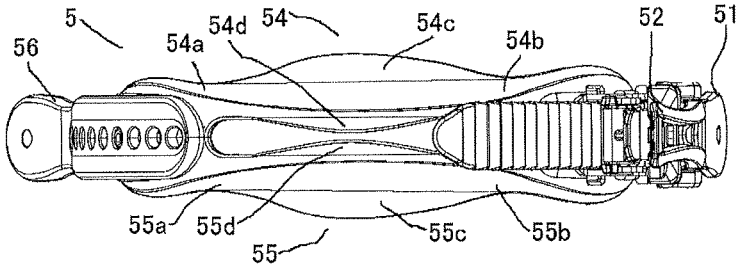
FIG. 4 is a plan view illustrating the toe strap part in a state where the toe strap ratchet band is coupled with the toe strap fastening tool according to the first embodiment of the present invention.
Figure 5:
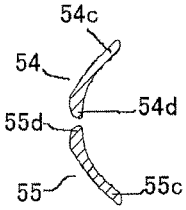
FIG. 5 is a cross-sectional view taken along a line AA according to the first embodiment of the present invention.
Figure 6:
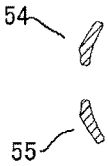
FIG. 6 is a cross-sectional view taken along a line BB according to the first embodiment of the present invention.

As illustrated in FIG. 1 to FIG. 9, a snowboard binding 1 according to a first embodiment of the present invention includes a base plate 2 that includes a securing means to a snowboard 200 on a center of a bottom face of the base plate 2, a back support 3 that has a lower end portion coupled to a rear end of the base plate 2, an ankle strap 4 that has one end coupled to one side 21 of the base plate 2 to fasten an instep 111 of a boot 100, an ankle strap ratchet band 41 that has one end coupled to another side 22 of the base plate 2, an ankle strap fastening tool 42 that is secured to another end of the ankle strap 4 and constituted of a ratchet buckle engaged with the ankle strap ratchet band 41, a toe strap 5 that has one end coupled to the one side 21 of the base plate 2 to fasten a tiptoe 113 of the boot 100, a toe strap ratchet band 51 that has one end coupled to the other side 22 of the base plate 2, and a toe strap fastening tool 52 that is disposed on another end of the toe strap 5 and constituted of a ratchet buckle engaged with the toe strap ratchet band 51.

To the ankle strap 4, a front-to-rear width expanding unit 43 that fastens an instep portion of the boot is secured.

The configuration is such that the ankle strap ratchet band 41 includes a plurality of ratchet teeth 41*a*, performing a fastening operation of the ankle strap fastening tool 42 with respect to the ratchet teeth 41*a* formed on the ankle strap ratchet band 41 causes the other end of the ankle strap 4 to move toward the other side 22 of the base plate 2, and the front-to-rear width expanding unit 43 fastens the instep 111 of the boot 100.

The toe strap 5 includes one belt 54 configured to fasten an upper portion of the tiptoe 113 of the boot 100, another belt 55 configured to fasten a tip of the tiptoe 113 of the boot, and a toe strap band 56 that has one end coupled to the one side 21 of the base plate 2 and another end coupled to one end of the belt portion.

The configuration is such that the toe strap ratchet band 51 includes a plurality of ratchet teeth 51*a*, performing a fastening operation of the toe strap fastening tool 52 with respect to the ratchet teeth 51 a formed on the toe strap ratchet band 51 causes the other end of the toe strap 5 to move toward the other side 22 of the base plate 2, and the one belt 54 and the other belt 55 simultaneously fasten the upper portion of the tiptoe and the tip of the tiptoe of the boot.

In this embodiment, the configuration is such that the one belt 54 and the other belt 55 of the toe strap 5 respectively include pairs of left and right front-to-rear width reducing units 54*a* and 54*b*, and 55*a* and 55*b*, on the one belt 54 and the other belt 55 of the toe strap 5, since the belt between the front-to-rear width reducing units uses the front-to-rear width reducing units 54*a*, 54*b*, 55*a*, and 55*b* as a starting point to easily generate distortion in a direction of a shaft rotation, abutting surfaces on the boot of the one belt 54 and the other belt 55 of the toe strap 5 move to appropriate positions along the shape of the tiptoe 113 of the boot 100 to be secured.

On the one belt 54 and the other belt 55 of the toe strap 5, to cause the belt between the front-to-rear width reducing units 54*a* and 54*b*, and 55*a* and 55*b* to use the front-to-rear width reducing units 54*a* and 54*b*, and 55*a* and 55*b* as starting points to easily generate distortion in a direction of a shaft rotation, a relation between a minimum front-to-rear width of the belt on the front-to-rear width reducing units 54*a*, 54*b*, 55*a*, and 55*b* and the thickness on the position of the minimum front-to-rear width is preferred to be small as much as possible in the difference while a required strength in fastening is maintained.

Between the pairs of left and right front-to-rear width reducing units 54*a* and 54*b*, and 55*a* and 55*b* of the one belt 54 and the other belt 55 of the toe strap 5, outside extending portions 54*c* and 55*c* that respectively extend from an outside position of the one belt 54 and the other belt 55 in the front-rear direction, and inside extending portions 54*d* and 55*d* that respectively extend from an inside position of the one belt 54 and the other belt 55 in the front-rear direction are formed.

Figure 7:
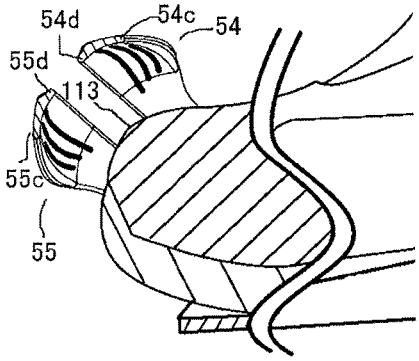
FIG. 7 is a reference diagram illustrating a state before the toe strap is secured to the boot according to the first embodiment of the present invention.
Figure 8:
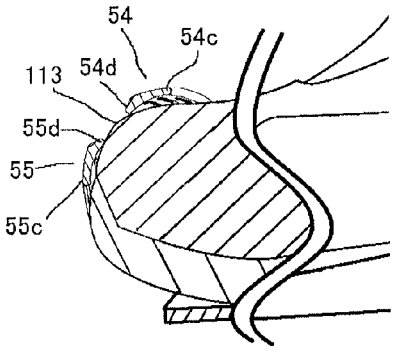
FIG. 8 is a reference diagram illustrating a state in the middle of securing the toe strap to the boot according to the first embodiment of the present invention.
Figure 9:
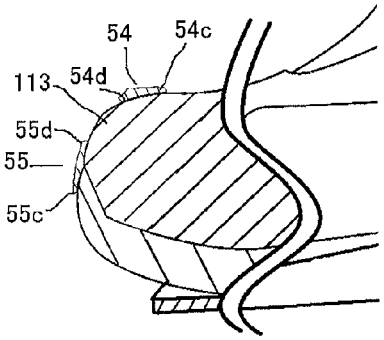
FIG. 9 is a reference diagram illustrating a state where the toe strap is secured to the boot according to the first embodiment of the present invention.
Figure 10:
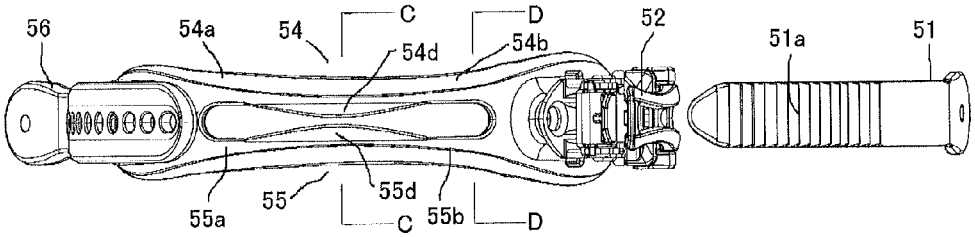
FIG. 10 is a plan view illustrating a toe strap part in a state where a toe strap ratchet band is separated from a toe strap fastening tool according to a second embodiment of the present invention.
Figure 11:
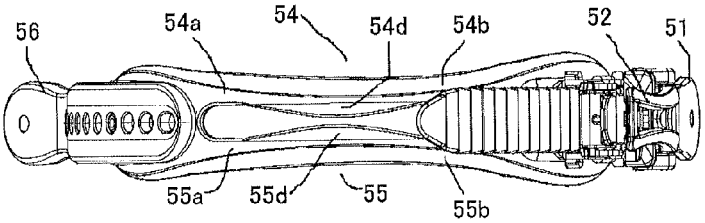
FIG. 11 is a plan view illustrating the toe strap part in a state where the toe strap ratchet band is coupled with the toe strap fastening tool according to the second embodiment of the present invention.
Figure 12:
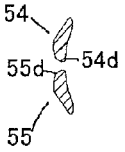
FIG. 12 is a cross-sectional view taken along a line CC according to the second embodiment of the present invention.
Figure 13:
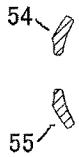
FIG. 13 is a cross-sectional view taken along a line DD according to the second embodiment of the present invention.
Figure 14:
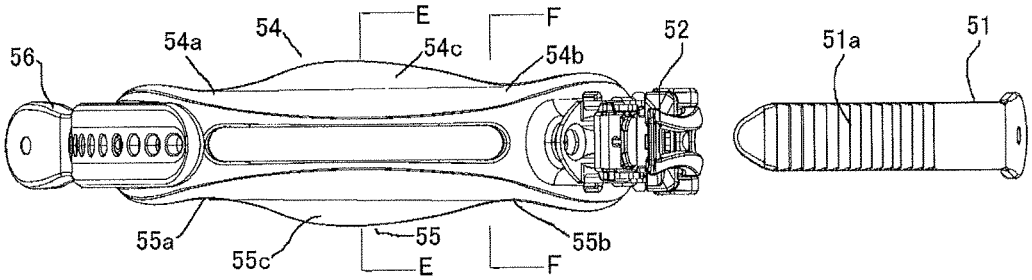
FIG. 14 is a plan view illustrating a toe strap part in a state where a toe strap ratchet band is separated from a toe strap fastening tool according to a third embodiment of the present invention.
Figure 15:
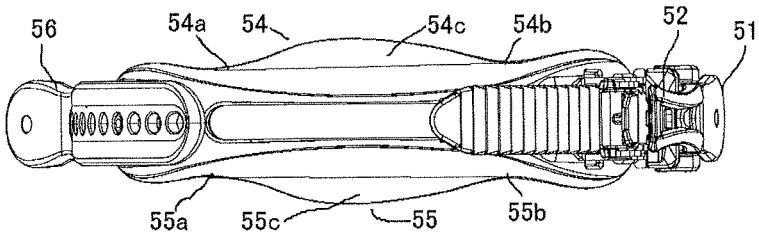
FIG. 15 is a plan view illustrating the toe strap part in a state where the toe strap ratchet band is coupled with the toe strap fastening tool according to the third embodiment of the present invention.
Figure 16:
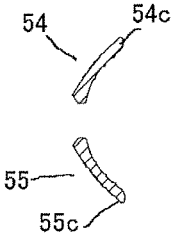
FIG. 16 is a cross-sectional view taken along a line EE according to the third embodiment of the present invention.
Figure 17:
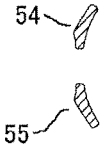
FIG. 17 is a cross-sectional view taken along a line FF according to the third embodiment of the present invention.

As illustrated in FIG. 7 to FIG. 9, abutting surfaces on the boot of the outside extending portions 54*c* and 55*c* and the inside extending portions 54*d* and 55*d* of the one belt 54 and the other belt 55 are formed inclining more to an abutting direction of the boot 100 compared with abutting surfaces on the boot 100 of the belts 54 and 55 of the non-extending portion on an adjacent position. This configures at least any of the outside extending portions 54*c* and 55*c* and the inside extending portions 54*d* and 55*d* of the one belt 54 and the other belt 55 of the toe strap 5 to abut on the boot 100 prior to the belts 54 and 55 of the non-extending portions when the boot 100 is mounted. Then, before the one belt 54 and the other belt 55 get in close contact with the tiptoe 113 of the boot 100, at least any of the outside extending portions 54*c* and 55*c* and the inside extending portions 54*d* and 55*d* abuts on the tiptoe 113 of the boot 100 to guide the one belt 54 and the other belt 55 to an appropriate mounting position. In this case, if the front-to-rear width reducing units 54*a*, 54*b*, 55*a*, and 55*b* are formed, the axial rotation and an angle displacement of the one belt 54 and the other belt 55 between the pair of left and right front-to-rear width reducing units 54*a* and 54*b*, and 55*a* and 55*b* is easily performed. This eliminates an excessive contact pressure on the abutting surface of the outside extending portions 54*c* and 55*c* and the inside extending portions 54*d* and 55*d* on the tip of the tiptoe 113 of the boot 100 to easily guide the one belt 54 and the other belt 55 to the appropriate mounting position smoothly.

Further, the outside extending portions 54*c* and 55*c* and the inside extending portions 54*d* and 55*d* are formed to have a thinner thickness compared with the one belt 54 and the other belt 55 of the non-extending portion on an adjacent position. Alternatively, on each boundary position of the outside extending portions 54*c* and 55*c* and/or the inside extending portions 54*d* and 55*d*, and the non-extending portion of the one belt 54 and the other belt 55, a thin-walled groove portion (not illustrated) is disposed. This increases the degree of freedom of undulation to guide the one belt 54 and the other belt 55 to the appropriate mounting position further smoothly. At the same time, when the toe strap 5 is fastened to the boot 100, the outside extending portions 54*c* and 55*c* and the inside extending portions 54*d* and 55*d* are in a state where the deformation is maintained with respect to the one belt 54 and the other belt 55 of the non-extending portion of the toe strap 5. Then, if a movement in a direction where a loosening is generated in a fastened state of the toe strap 5 with respect to the boot 100 occurs, the outside extending portions 54*c* and 55*c* and the inside extending portions 54*d* and 55*d* move in a direction to release the deformation with respect to the non-extending portion of the one belt 54 and the other belt 55. This prevents a rapid decrease of a holding force to the boot 100.

A coupling portion of the one end of the toe strap band 56 to the one side 21 of the base plate 2, and a coupling portion of the one end of the toe strap ratchet band 51 to the other side 22 of the base plate are configured to be turnably with respect to the base plate. An upper portion 114 of the tiptoe 113 of the boot 100 can also be fastened by both the one belt 54 and the other belt 55 of the toe strap 5. In this case, when the toe strap 5 is fastened to the boot 100, the outside extending portions 54*c* and 55*c* and the inside extending portions 54*d* and 55*d* are in a state where the deformation is maintained with respect to the one belt 54 and the other belt 55 of the non-extending portion of the toe strap 5. Then, if a movement in a direction where a loosening is generated in a fastened state of the toe strap 5 with respect to the boot 100 occurs, the outside extending portions 54*c* and 55*c* and the inside extending portions 54*d* and 55*d* move in a direction to release the deformation with respect to the non-extending portion of the one belt 54 and the other belt 55. This prevents a rapid decrease of a holding force to the boot 100.

Second Embodiment

As illustrated in FIG. 10 to FIG. 13, the snowboard binding 1 according to a second embodiment of the present invention does not include the outside extending portions 54*c* and 55*c* on the one belt 54 and the other belt 55 of the toe strap 5, and includes only the inside extending portions 54*d* and 55*d* in the snowboard binding 1 of the first embodiment.

Third Embodiment

As illustrated in FIG. 14 to FIG. 17, the snowboard binding 1 according to a third embodiment of the present invention does not include the inside extending portions 54*d* and 55*d* on the one belt 54 and the other belt 55 of the toe strap 5, and includes only the outside extending portions 54*c* and 55*c* in the snowboard binding 1 of the first embodiment.

Figure 18:
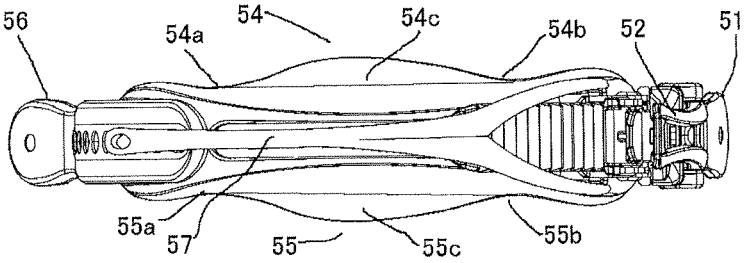
FIG. 18 is a plan view illustrating the toe strap part in a state where the toe strap ratchet band is coupled with the toe strap fastening tool according to a modification of the third embodiment of the present invention.

In this embodiment, as illustrated in FIG. 18, a center regulating member 57 that regulates an intrusion distance of the tiptoe 113 of the boot 100 to between the one belt 54 and the other belt 55 is disposed on an upper position between the one belt 54 and the other belt 55 of the toe strap 5 in a lateral direction. One end and another end of the center regulating member 57 are respectively secured to one end and another end of a belt portion 53 constituted of the one belt 54 and the other belt 55. The center regulating member 57 may include a length adjustment mechanism on a fixed position of the one end (not illustrated). The center regulating member 57 may not necessarily be disposed.

Figure 19:
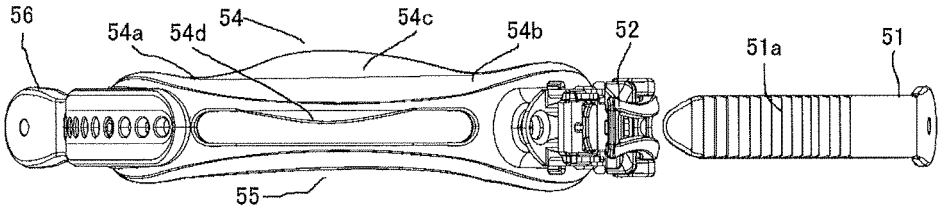
FIG. 19 is a plan view illustrating a toe strap part according to a further modification of the present invention.
Figure 20:
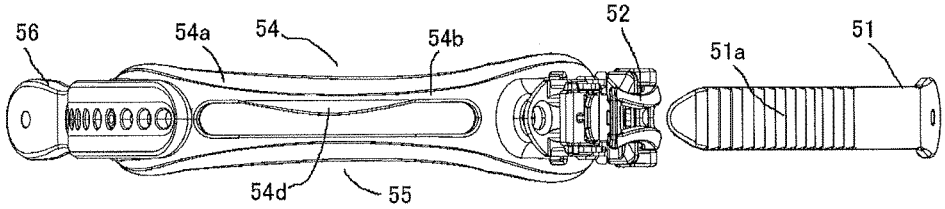
FIG. 20 is a plan view illustrating a toe strap part according to a further modification of the present invention.
Figure 21:
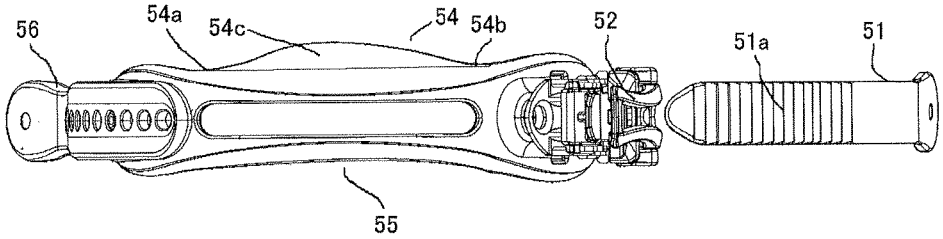
FIG. 21 is a plan view illustrating a toe strap part according to a further modification of the present invention.
Figure 22:
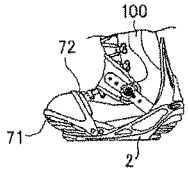
FIG. 22 is a side view illustrating a state where a boot is mounted according to a conventional technique.
Figure 23:
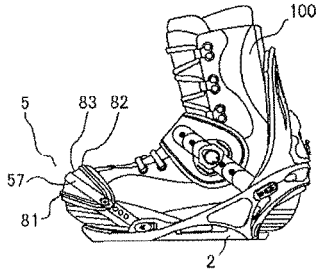
FIG. 23 is a side view illustrating a state where a boot is mounted according to a conventional technique.

As further modifications of the present invention, as illustrated in FIG. 19, FIG. 20, and FIG. 21, the outside extending portions 54*c* and 55*c* and/or the inside extending portions 54*d* and 55*d* may be disposed on only any one of the one belt 54 or the other belt 55 of the toe strap 5.

INDUSTRIAL APPLICABILITY

The snowboard binding of the present invention is a snowboard binding that includes the toe strap easily fastened to the appropriate position with respect to the shape of the tiptoe portion of the boot when the toe strap is fastened to the boot, so as to ensure efficient use in industrial field.

DESCRIPTION OF REFERENCE NUMERAL

1: binding, 2: base plate, 3: back support, 4: ankle strap, 5: toe strap, 21: one side, 22: other side, 41: ankle strap ratchet band, 41*a*: ratchet teeth, 42: ankle strap fastening tool, 43: front-to-rear width expanding unit, 51: toe strap ratchet band, 51*a*: ratchet teeth, 52: toe strap fastening tool, 54: one belt, 55: other belt, 56: toe strap band, 57: center regulating member, 71: portion to fasten a tip, 72: portion to fasten an upper portion, 81: lower belt, 82: upper belt, 83: pad, 100: boot, 111: instep, 113: tiptoe, 200: snowboard

The invention claimed is:

1. A snowboard binding comprising:

a base plate that includes a securing means to a snowboard, a back support coupled to a rear end of the base plate, an ankle strap that has one end coupled to one side of the base plate to fasten an instep of a boot, an ankle strap ratchet band that has one end coupled to another side of the base plate, an ankle strap fastening tool disposed on another end of the ankle strap and engaged with the ankle strap ratchet band, a toe strap that has one end coupled to the one side of the base plate to fasten a tiptoe portion of the boot, a toe strap ratchet band that has one end coupled to the other side of the base plate, and a toe strap fastening tool disposed on another end of the toe strap and engaged with the toe strap ratchet band, wherein the toe strap includes a first belt configured to fasten an upper portion of the tiptoe of the boot and a second belt configured to fasten a tip of the tiptoe of the boot, the snowboard binding is configured such that a fastening operation of the toe strap fastening tool engaged with the toe strap ratchet band moves the toe strap toward the other side of the base plate to cause the first belt and the second belt to simultaneously fasten the upper portion of the tiptoe and the tip of the tiptoe of the boot, at least one belt of the first belt and the second belt includes an extending portion that extends at least any direction of front and rear at a center position of a lateral direction of the belt, wherein the first belt and/or the second belt that includes the extending portion extends further in the front and/or rear direction at the extending portion than a portion of the first belt and/or the second belt that does not include the extending portion, and the extending portion of the belt is configured to abut on the boot prior to a non-extending portion of the belt at an adjacent position when the boot is mounted.

2. The snowboard binding according to claim 1, wherein the extending portion of the belt is formed thin compared with the non-extending portion of the belt at the adjacent position.

3. The snowboard binding according to claim 1, wherein the extending portion of the belt has an abutting surface on the boot formed inclining more to an abutting direction of the boot compared with an abutting surface on the boot of the belt of the non-extending portion at the adjacent position.

4. The snowboard binding according to claim 1, wherein the extending portion of the belt includes an outside extending portion that extends from an outside position of the first belt and the second belt in a front-rear direction.

5. The snowboard binding according to claim 1, wherein the extending portion of the belt includes an inside extending portion that extends from an inside position of the first belt and the second belt in the front-rear direction.

6. The snowboard binding according to claim 1, wherein a center regulating member that regulates an intrusion distance of the tiptoe of the boot to between the first belt and the second belt of the toe strap is disposed on an upper position between the first belt and the second belt of the toe strap in a lateral direction.

7. The snowboard binding according to claim 1, wherein at least one belt of the first belt and the second belt includes pairs of left and right front-to-rear width reducing units at both ends of left and right directions of the belt.

* * * * *